340-566
10/23/84 OR 4,479,114

United States Patent [19]

Yamamoto

[11] Patent Number: 4,479,114

[45] Date of Patent: Oct. 23, 1984

[54] OMNIDIRECTIONAL ACCELERATION ALARM AND SWITCH THEREFOR

[76] Inventor: Yujiro Yamamoto, 1201 Via La Jolla, San Clemente, Calif. 92672

[21] Appl. No.: 423,666

[22] Filed: Sep. 27, 1982

Related U.S. Application Data

[62] Division of Ser. No. 270,262, Jun. 4, 1981, Pat. No. 4,386,341.

[51] Int. Cl.[3] ..... G08B 13/02; G08B 13/14

[52] U.S. Cl. ..... 340/566; 200/61.49; 340/65; 340/669

[58] Field of Search ..... 340/566, 65, 571, 384 E, 340/692, 669; 200/61.49, 61.45 R; 181/0.5; 367/139; 179/1.5 M

[56] References Cited

U.S. PATENT DOCUMENTS

| | | | |
|---|---|---|---|
| 3,557,899 | 1/1971 | Longinette et al. | 367/139 |
| 3,566,347 | 2/1971 | Flanders | 340/384 E |
| 3,731,022 | 5/1973 | Loptus | 200/61.49 |
| 4,075,625 | 2/1978 | Cieslar et al. | 340/384 E |

*Primary Examiner*—Glen R. Swann, III
*Attorney, Agent, or Firm*—Grover A. Frater

[57] ABSTRACT

A security device incorporates apparatus for producing a special alarm sound in response to a change in acceleration sensed with a special omnidirectional sensor and under the control of special SCR circuitry. The circuitry and sensor are especially adapted for the security application but have independent utility.

10 Claims, 5 Drawing Figures

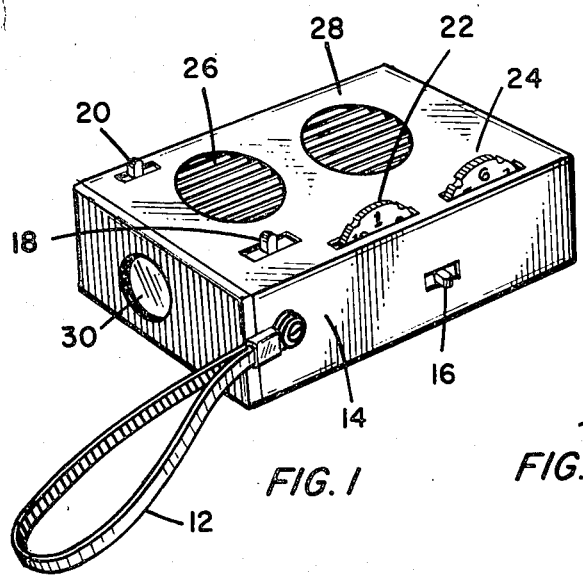
FIG. 1
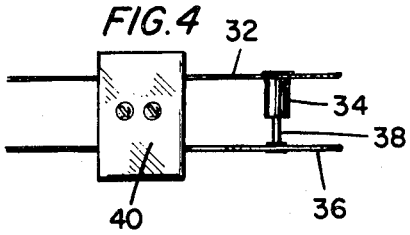
FIG. 4
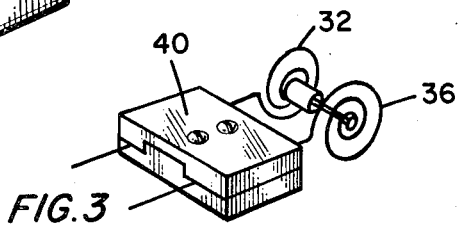
FIG. 3
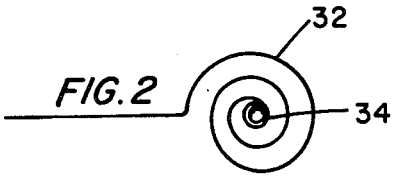
FIG. 2
FIG. 5
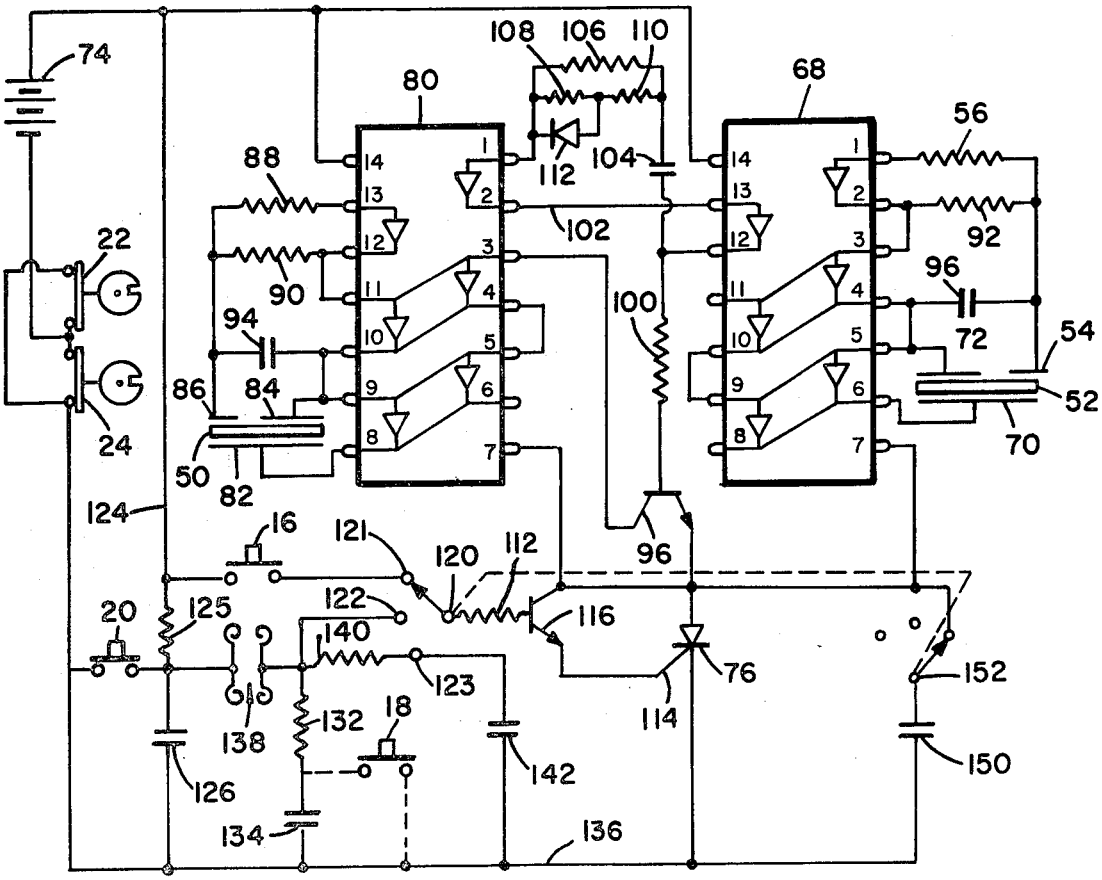

OMNIDIRECTIONAL ACCELERATION ALARM AND SWITCH THEREFOR

TECHNICAL FIELD

This invention relates to security systems and to improved motion sensors and timing circuitry for security and other applications.

CROSS-REFERENCE TO RELATED APPLICATION

This is a division application of application Ser. No. 270,262, filed June 4, 1981, entitled Electronic Apparatus now U.S. Pat. No. 4,386,341, issued May 31, 1983.

BACKGROUND ART

Most security apparatus falls in one of two broad classes. The first of those classes is formed by locks and fences and other apparatus whose purpose is to physically prevent a violation of security. In the second class falls that apparatus which includes a sensing means to detect an actual or potential security violation and which generates a signal which is used either in attempting to deter the violator or to facilitate his identification and capture.

This second class of apparatus is usually intended to deal with one of three kinds of security violation. Thus, some apparatus and systems are concerned with intrusion into a place that is to be secured. Some apparatus of this second class is employed to prevent theft of apparatus. Most of the remainder of the security hardware in this class is used to protect individuals against attackers.

To a large extent the sensors employed in this second class of material are specific to a particular task. A wide variety of approaches have been used. In some cases switches are opened and closed. Motion is sensed. Some involve measurement of echoes of sonic or radio signals. The use of different principles and cost considerations have led to a wide variety of very specialized apparatus each with a limited purpose. Change in acceleration sensors, which are usually called "motion sensors" in this art, are usually capable of detecting motion only in two dimensions. In cases where detection of security violation is used to deter the violation, the theory of the apparatus is to sound an audible alarm as loudly as the available power and cost permit.

DISCLOSURE OF INVENTION

The invention provides security apparatus of the second class. It senses acceleration change because such change is a factor that is common to all three classes - to personal security, to prevention of theft, and to prevention of intrusion. A security apparatus that senses change in acceleration can have wide application if sensing is omnidirectional and if it is provided in a reliable and low cost form.

The invention provides a "motion" sensor which is omnidirectional in its response, which is highly sensitive, which is low in cost, which incorporates amplitude limiting to withstand mechanical shock, which requires no power while awaiting an input, and which is not disabled but continues to sense after first sensing motion.

The sensor senses completion of an electrical circuit in response to change in acceleration. In preferred form the sensor comprises two flat coiled springs each having an element mounted at the center of the spring which extends in the direction of the other. The springs are mounted such that change in acceleration of the mount in any direction results in motion of the two springs such that the two elements engage one another. While that is the preferred form, a number of variations are possible including a variation that employs only a single spring, and variations in which the springs have different configurations.

Such a sensor can be mounted on a door or a window or at any other entry point to sense intrusion. It can be mounted upon or contained in an article or apparatus that could be carried off by a thief.

In a personal security application the sensor would be carried by the person seeking protection, and could be activated either by that person or that person's attacker.

Each of these applications will require that some means be provided for inactivating either the sensor or the apparatus that utilizes the sensor output. In most cases the inactivation scheme should be one that is itself secure. It should be easily activated and deactivated by authorized persons but not by those who are unauthorized.

The invention provides a novel combination lock with which to secure the activation and deactivation functions.

It is quite common for security devices of the kind that incorporate sensors to include an apparatus for sounding an alarm. While some attempt has been made to make that sounding distinctive, it has been the practice in most cases in the past to provide the loudest sound that power and cost limitations would permit. In a preferred form of the invention an alarm is sounded on the occasion of a security violation, and the alarm is loud. Its similarity to past practices, however, ends at that point.

Increased loudness permits the alarm to be heard at a greater distance which increases the liklihood that the alarm will be heard and will be heeded. At some point, usually above 90 db., sound results in pain and irritation. Accordingly, loud sounds discourage the violator not only because the alarm may be heard by another person but also because the violator needs to escape from it. The invention adds a new dimension. It sounds an alarm in a way that acts directly on the hearer's instincts, and makes it urgent for him to escape in a degree that reason does not overcome. That is accomplished by using two tones in the midrange of audible response and which differ from one another at relatively low frequency—50 to 200 cycles per second. One of those tones is interrupted at a subaudible frequency, preferably three to eight cycles per second. Experiment has shown that it is preferably that the "on" time in each cycle exceed the "off" time. In a preferred embodiment the audible alarm consists of two tones in the frequency range 2500 to 3100 cycles per second. The frequencies differ from one another by approximately 100 cycles per second, and one of the tones is interrupted cyclically by being interrupted for about 5/100ths of a second after sounding for 2/10ths of a second so that the interruption frequency is 4 Hz. It is preferred that the sound be as loud as possible, not less than 90 db. in the immediate vicinity of the sounder.

Whatever its other advantages, security apparatus will have limited utility unless it is reliable and can be produced at reasonable cost. It is an object of the invention to provide a security apparatus which will serve multiple purposes. That is, it is desired to provide a security apparatus which, in its single form, can be adapted to a wide variety of security tasks. To do that the apparatus should be capable of being operated from an internal power supply. While the invention is applicable in situations where external power is available, nonetheless the preferred embodiment is battery powered, and the invention includes special circuitry that permits the production of very high intensity sounds for long periods of time, using small, inexpensive dry cell batteries. To provide that feature the invention provides a special timing apparatus and special sounders. More particularly, the invention provides a special circuit arrangement involving an oscillatory load and a silicon controlled rectifier device, or its equivalent, and a special rectifier control circuit.

BRIEF DESCRIPTION OF THE DRAWINGS

In the drawings:

FIG. 1 is an isometric view of a small, self-contained security apparatus which incorporates the several features of the invention;

FIG. 2 is a view in side elevation of a motion sensing spring of the kind used in the apparatus of FIG. 1;

FIG. 3 is an isometric view of the motion sensor in which the spring of FIG. 2 is incorporated;

FIG. 4 is a top plan view of the motion sensor of FIG. 3; and

FIG. 5 is a circuit diagram of the electrical apparatus incorporated in the unit of FIG. 1.

DESCRIPTION OF THE PREFERRED EMBODIMENT

The security device which is generally designated 10 in FIG. 1 is housed in a case which is formed of high impact plastic material and which, in this particular preferred embodiment, measures about $1\frac{1}{4}'' \times 2'' \times 3''$. It is small enough to be carried in a person's purse or pocket or mounted inside an office machine or a machine tool. A carrying strap 12 is mounted on the case 14 so that the unit can be carried on a person's wrist or hung on the back of a door or from the frame of a window. It can be hung from the interior side of an automobile or truck door or simply strapped to the exterior of a package or load of material or bicycle or anything else that might go unattended for short periods.

The device is armed and disarmed by operation of one or more of its several switches. There are three switches that are accessible from the exterior of the case, and they are designated 16, 18 and 20 in FIG. 1. In addition, activation and deactivation is controlled by a "combination lock" which is formed by two thumb wheels 22 and 24 which, in this embodiment, provide sixty-four combinations independently of operation of the three switches 16, 18 and 20. The combination is user adjusted, and an internal timing circuit, which can be accessed with one of the switch buttons, postpones operation and sounding of the alarm to permit the device to be set and disabled without sounding of the alarm. There are two sounders within the case 14, one below each of the grills 26 and 28. Sound emerges from those grills and from sound openings at the ends of the case. One of those sound openings is visible in FIG. 1 where it is designated 30. The other opening is at the opposite end of the case. Thus arranged, the sound cannot be muffled with one hand. When it is armed, and after a short time delay, any movement of case 14 beyond a very small and slow movement will be sensed by a special detector that is housed within the case. The detector of this embodiment is shown in FIGS. 3 and 4. Other forms are possible but this one is preferred. One of a pair of two switch contacts is mounted on a spring which is configured so that it will wriggle and move the switch contact it carries in response to any significant degree of acceleration change in any direction. The preferred embodiment uses two such springs. The spring comprises a length of spring material one end of which is coiled and, when relaxed, lies in a single plane. It carries a switch contact at its center and that contact extends transversly to the plane of the spring. In FIG. 2 the spring 32 carries at its center a hollow cylindrical contact 34. The other spring 36 is wound in the opposite direction as best shown in FIG. 3 and it carries at its center a pin 38. The two springs are mounted in a mounting block 40 so that the pin 38 extends into the interior of the cylinder 34 when the two springs are in relaxed condition. In this embodiment the weight of the cylinder 34 and of the pin 38 is substantially the same, and the springs 32 and 36 have substantially the same characteristics. If one sags, the other sags, and that is true whether the sensor is placed right side up or upside down or on end or on one side or the other side. In the absence of some change in acceleration the pin does not contact the cylinder 34, and no electric circuit between the two contacts is completed. Upon the occasion of the unit being accelerated in any direction, the springs will begin to wriggle. In each case the center of gravity lies outside of the plane of the spring so the wriggling motion will be three dimensional and the pin 38 will engage the interior wall of the cylinder as long as there is any change in acceleration, and for some time thereafter because the system includes virtually no damping except to the extent that the pin and the cylinder or cup 34 engage and rub upon one another.

The switch created by these elements includes both pressure contact and wiping action at switch closure. It will be apparent to those skilled in the art that a number of configurations can provide the desired result. The configuration of the springs, the orientation of the springs, and the shape and orientation of the contacts can all be changed. In fact, the invention can be practiced with a structure that involves a single spring. However, the use of two springs is preferred, and the use of the spiral configuration at the end of an uncoiled section is also preferred.

The preferred embodiment of the invention uses two piezo-electric sounders. These devices are piezo-electric elements mounted so that the elements are located in the electric field between a single plate at one side and a pair of plates at the other side. Alternating potential applied across the piezo-electric element from the single plate at one side to one of the plates on the other side results in dimensional change. That dimensional change results in successive compression and rarifaction of the adjacent film of air, and those pressure changes are transmitted as sound. The third plate is used as a feedback signal pickup. In FIG. 5 one of those sounders is designated 50, and the one at the right is designated 52. Each of the sounders is connected in a multivibrator circuit which includes the sounder and an oscillator consisting of a three stage amplifier. In the case of sounder 52 the potential changes at the pickup element 54 are applied through a resistor 56 to the input of the amplifier that appears between terminals 1 and 2 of the six section amplifier chip 68. The output of that amplifier is applied to the input of the amplifier that is connected between terminals 3 and 4 and the amplifier that is connected between terminals 10 and 11. Those two amplifiers are connected in parallel and their output is applied to the input of another pair of amplifiers which are connected in parallel and are identified as the amplifiers that appear between terminals 5 and 6 and terminals 8 and 9 of the chip. The output of that pair of amplifiers is applied to the plate or coating 70 at the opposite side of the piezo-electric element. On the other side of the element the plate or coating 72 is connected to the input of the last pair of amplifiers. There is a signal inversion in each amplifier set, and the signal at plate or coating 54 is 180° different than the signal at plate or coating 72, so it is clear that the circuit operates as a multivibrator when electrical power is applied between the positive terminal 14 of the chip and its negative terminal 7. The source of power is the battery 74 at the left side of the diagram. Except when the two "combination lock" switches 22 and 24 are both in the open position, the chip 68 and its amplifiers are connected across the battery through SCR 76 when that SCR is rendered conductive.

The other sounder 50 is connected in a similar multivibrator circuit. The amplifiers that appear between terminals 5 and 6 and between terminals 9 and 8 of the chip 80 are connected in parallel across the plate or conductive coating 82 at one side of the piezo-electric sounder and the larger plate or conductor 84 at the opposite side. The input of those two amplifiers is connected to the output of that parallel combination of amplifiers formed by the amplifiers connected between terminals 3 and 4 and terminals 11 and 12 of the chip. The input to those two amplifiers is derived from the output of the amplifier that appears between terminals 13 and 12 of chip 80. The feedback pickup layer or coating 86 is connected to the input of the terminal of 13/12 amplifier through a resistor 88. Timing in the two circuits is controlled by the combination of a resistor and a capacitor which are connected across the driving amplifiers. The resistors are numbered 90 and 92, respectively, in the circuits of sounders 50 and 52. In the case of sounder 50 the frequency control capacitor is numbered 94, and in the case of sounder 52 it is numbered 96.

The two multivibrator circuits are the same except that they operate at a frequency difference of about 100 cycles per second. In addition, provision is made for grounding the input of the amplifier pair that is connected between terminals 3 and 4 and 11 and 12 of chip 80. When the input of those amplifiers is grounded oscillation ceases and sounder 50 is silent. The ground connection is made through a transistor 96 and the SCR 76 when the transistor 96 is turned on. A third multivibrator turns transistor 96 on and off by applying a signal to the base of transistor through resistor 100. The signal applied to the base of the transistor 96 is the signal that appears at the output of an amplifier connected between terminals 13 and 12 of chip 68. That amplifier, and the amplifier in chip 80 which appears between terminals 1 and 2, are connected in a multivibrator circuit which is formed by connecting the output of the chip 80 amplifier to the input of the chip 68 amplifier through a connection 102 which incorporates no time delay. The output of the chip 68 amplifier is connected to the input of the chip 80 amplifier through the series combination of a capacitor 104 and a resistor which comprises the combination of a resistor 106 in parallel with the series combination of resistors 108 and 110. Having in mind that there are ground return circuits associated with the amplifiers within the chips 68 and 80, there is a current reversal in the resistance capacitance circuit. The diode 112 short circuits resistor 108 in one direction of flow, but not the other, and that circumstance is used to provide different on and off times in that multivibrator arrangement.

Summarizing the operation to this point, when the SCR 76 is rendered conductive, power is applied to all three multivibrators to the end that sounder 52 operates continuously at one frequency and sounder 50 operates at another frequency, 100 cycles different. The operation of sounder 50 is interrupted periodically at a frequency controlled by the frequency of the multivibrator formed by resistors 106, 108 and 110 and the capacitor 104, and the ratio of on and off times of sounder 50 is controlled by the relative values of resistors 108 and 110. These three multivibrators present a load to the SCR 76 which alternates between a very low and a very high value. In effect, the potential that is applied across SCR 76 is not continuous; instead, it is the potential of the battery 74 interrupted by the three multivibrators. It is a characteristic of silicon controlled rectifiers that they cannot be turned off, after having been turned on, unless the potential across the SCR is reduced to zero or near zero. These several multivibrators present a load which has the effect of periodically reducing the potential across the SCR 76 to zero. Because of that, timing of multivibrator operations can be controlled by controlling the potential on the starting electrode 114 of the SCR 76. In this case, timing is controlled by conduction in the emitter collector circuit of a transistor 116. The collector is connected to the positive side of the silicon controlled rectifier, and the emitter is connected to the control element 114. The potential at the control element is determined by the potential at the base of transistor 116. That potential is applied through an isolation resistor 118 from a three position switch 120. One of the switch positions is numbered 121, another is numbered 122, and the third is numbered 123. If the apparatus is to be used as a personal security device, the moveable contact of the switch is moved to position 121.

If it is to be used as an anti-theft device, the moveable contact would be moved to position 122 for immediate operation. On the other hand, if the device is to be used as an anti-intrusion apparatus, the moveable contact would be moved to position 123 because, in that position, the alarm is not sounded until some time interval following closure of the motion or acceleration sensors.

To complete the circuit description, there is a series circuit comprising line 124, resistor 125 and a capacitor 126 in parallel with the series combination of source 74 and the two sections 22 and 24 of the combination lock. A normally open switch 20 is connected in parallel with capacitor 126. The switch position or contact 121 is connected through a normally open switch 16 to line 24 at the positive side of the source battery 74. The junction between resistor 125 and capacitor 126 is connected to one side of each of two spiral spring acceleration sensors 138. The other spring of the two sensors are connected together and to the switch position or contact 122. The series combination of a resistor 132 and a capacitor 134 are connected in series, in that order, from switch position 122 to the negative line 136 which is connected to the negative side of source battery 74 through the two sections 22 and 24 of the combination lock. A switch 18 is shown to be connected across capacitor 134, but the lines are shown in dashed form because this switch is optional in the sense that, in large measure, the function it performs is performed by switch 20. The switch position or contact 123 is connected to switch position or contact 122 through a resistor 140, and it is also connected to the ground line through a timing capacitor 142.

The silicon controlled rectifier remains turned on so long as there is a minimum control current in line 114 and a supply potential across the main terminals of the SCR. The current flow through the control electrode is returned to the ground line 136. Thus, the SCR will be turned on only if the potential applied to line 114 is positive, with respect to line 136, by some minimum amount. Thus, the silicone controlled rectifier 76 will be turned on if the potential across capacitor 142 is more than some minimum amount, and it will be turned on if the potential at the base of transistor 116 is positive.

If it is desired to utilize the device to frighten away intruders, the internal switch is moved so that the moveable contact 120 is in position or engages contact 123. In this position the apparatus is arranged so that it will be operative only when the switches 22 and 24 are closed, and it will become operative only after an initial time delay during which the user has time to place the device in desired position after arming it by operation of the combination lock or switches 22 and 24. Even after the device is moved and an acceleration is detected, some time elapses before the alarm is sounded so that the user is given time to disarm the device when sounding is no longer required. If the device is not rendered inoperative within that time delay period, following initial sensing of an acceleration, the sounder will operate for a length of time determined by the third time delay circuit.

The timer that determines the initial delay period is formed by the combination of resistor 125 and 126. The timer that determines the period between sensing of an acceleration and the beginning of the sounding of the alarm is mainly formed by the combination of resistors 132 and 140 and capacitor 142. Finally, the timer that determines the duration of the sounding is mainly formed by capacitor 134 and the resistance between the control element 114 and the ground line 136. Let it be supposed that the device of FIG. 1 will be used to sound an alarm if a door is opened. In that circumstance, the internal switch is set so that contact 120 engages the switch position or contact 123. The combination lock is turned so that switches 22 and 24 are closed. They are closed in every position except one, and both must be in its respective open position before the circuit can be opened. That having been done, capacitor 126 is charged through resistor 125. The user depresses switch 20 to ensure that the capacitor 126 is discharged while he hangs the device from the knob at the inner side of the door. He then releases switch 20 and closes the door and locks it. Capacitor 126 will then be charged through resistor 125. If the door is opened, or is subjected to enough force to move the security device, the spiral springs of the sensor 138 will be set into motion. As soon as there is momentary contact at one of the two redundant sensors, the capacitor 126 will discharge into capacitor 134 through the small resistor 132. Thereafter the capacitor 134 will discharge through the small resistor 132 and a larger resistor 140 into capacitor 142. After a time delay determined primarily by the potential across capacitor 142 and the value of resistor 140, the charge across capacitor 142 will have reached a value sufficiently high to trigger the silicone controlled rectifier 76 to apply power to the three multivibrators whereupon sounders 50 and 52 will be operative. When the charge in capacitors 134 and 142 has dissipated sufficiently to ground through the control electrode 114 of the SCR, the SCR will turn off at the next occasion when the load presented by the multivibrators effectively reduces the potential across the SCR to zero. The purpose of the second timer is to permit the user to open the door and disable the security device by operation of the combination lock prior to sounding of the alarm.

If the apparatus is used as a protection against theft, it is mounted at the exterior of the thing being protected, and then the moveable contact 120 of the internal switch is moved to switch position 122. In this position, after the initial time delay provided by the combination of resistor and capacitor 126 which permits the device to be set into position without sounding the alarm, any acceleration will close the sensor switch 138. Thereupon the charge in capacitor 126 will immediately charge capacitor 134, and that potential will be available through the internal switch and resistor 118 at the base of transistor 116. The transistor will be turned on and current will be permitted to flow in the control electrode of the SCR. In that case, the SCR will turn on immediately and sounding of the alarm begins with no further time delay.

If the internal switch is set to the personal protection position in which contact 120 is placed in switch position 121, then the base of transistor 116 is made positive as soon as the switch 16 is closed. The user who fears an attack holds the device so that switch 16 can be pressed as soon as it is desired to have the alarm sound. It will continue to sound as long as the switch is held closed. If an attack occurs, capacitor 126 will be charged and the sensor 138 will detect acceleration as a consequence of the attack in which case the apparatus will operate in the manner described when the internal switch is in the anti-intrusion position.

Switch 18 is optional. It will serve the same function as will switch 20 in certain instances. In the preferred embodiment the switch is included but it is not connected. Its presence introduces another variable into the problem faced by the attacker or the intruder or the thief who tries to turn off the device.

Capacitor 150 is included in the preferred circuit. It is connected in series with a switch 152 across the SCR 76. The switch operates in unison with the switch formed by moveable contact 120 and fixed contacts 121, 122 and 123. Switch 152 is closed when moveable contact 120 engages contact 121. The capacitor 150 is charged when the switch is closed. Therefore, after a closure of slide switch 16 to initiate turn on of the SCR, the switch 16 may be opened without discontinuance of the sounding. In the absence of capacitor 150, sounding ends when the switch 16 is opened.

Although I have shown and described certain specific embodiments of my invention, I am fully aware that many modifications thereof are possible. My invention, therefore, is not to be restricted except insofar as is necessitated by the prior art.

I claim:

1. In a security system:

sound generating means for generating two audible tones and interrupting means for interrupting one of said tones at a sub-audible rate; and acceleration detection means for initiating operation of said sound generating means comprising a switch having one of its contacts mounted for movement in response to movement of a spring and weight combination capable of omnidirectional movement relative to the other contact of said switch.

2. The invention defined in claim 1 in which said spring and weight comprises a length of spring material having a portion lying in one plane and carrying a weight whose center of gravity lies outside said plane.

3. The invention defined in claim 2 in which said acceleration detection means comprises two spring and weight combinations and in which said switch has two contacts each mounted for movement in response to movement of a respectively associated one of said spring and weight combinations.

4. The invention defined in claim 1 in which said spring and weight combination comprises a spirally wound spring having the weight fixed to the spring at the region of the center of the spiral.

5. The invention defined in claim 1 which further comprises power means for providing electrical power to said sound generating means;

said power means comprising an electronic switch in series with said sound generating means and being of a type which is rendered non-conductive in the absence of supply potential and in which conduction is initiated by current flow at a control element while said electronic switch is subjected to supply potential;

said sound generating means being effective to interrupt periodically the application of supply potential to said electronic switch; and electronic switch control means for causing current flow at said control element in response to change in the state of a condition.

6. The invention defined in claim 5 in which said electronic switch control means comprises said detection means.

7. The invention defined in claim 5 in which said electronic switch control means comprises said detection means effective, when actuated, to initiate current flow at said control element, and a first timer effective to render said switch incapable of initiating current flow at said control element for a predetermined time interval.

8. An acceleration detector comprising a spring and weight combination;

a switch having one of its contacts mounted for movement in response to movement of said spring and weight combination, said spring and weight being capable of omnidirectional movement relative to the other contact of said switch, said spring and weight combination comprising a spring having a portion lying in one plane and carrying the weight such that the center of gravity of the weight lies outside said one plane.

9. An acceleration detector comprising a spring and weight combination;

a switch having one of its contacts mounted for movement in response to movement of said spring and weight combination, said spring and weight being capable of omnidirectional movement relative to the other contact of said switch, said spring and weight combination comprising a spirally wound spring having the weight fixed to the spring at the region of the center of the spiral.

10. An acceleration detector comprising a spring and weight combination;

a switch having one of its contacts mounted for movement in response to movement of said spring and weight combination, said spring and weight being capable of omnidirectional movement relative to the other contact of said switch, said spring comprising a length of spring material one portion of which is wound in spiral form.

* * * * *